US005307722A

United States Patent [19]

La Rosa

[11] Patent Number: 5,307,722

[45] Date of Patent: May 3, 1994

[54] PICK FOR STRINGED MUSICAL INSTRUMENTS

[76] Inventor: Raul D. La Rosa, 6420 Wagon Loop, Greenstone Country, Placerville, Calif. 95667

[21] Appl. No.: 914,862

[22] Filed: Jul. 15, 1992

[51] Int. Cl.[5] ..... G10B 3/16

[52] U.S. Cl. ..... 84/322; D17/20

[58] Field of Search ..... 84/322, 321, 320; D17/20

[56] References Cited

U.S. PATENT DOCUMENTS

| | | | |
|---|---|---|---|
| 655,959 | 8/1990 | Cochrane | 84/322 |
| 998,440 | 7/1911 | Willat | 84/322 |
| 1,009,403 | 11/1911 | Gaynor | 84/322 |
| 1,117,056 | 11/1914 | Knackstedt | 84/322 |
| 1,263,740 | 4/1918 | Burdwise | 84/322 |
| 1,461,070 | 7/1923 | Rudesyle | 84/322 |
| 3,112,668 | 12/1963 | Moshay | 84/322 |
| 4,790,227 | 12/1988 | Lukehart | 84/322 |

*Primary Examiner*—Michael L. Gellner
*Assistant Examiner*—Cassandra Spyrou
*Attorney, Agent, or Firm*—Donald E. Schreiber

[57] ABSTRACT

A unitary pick for plucking a stringed musical instrument includes a flat blade having a longitudinal axis. The blade has a pointed end for engaging strings of a musical instrument. The blade also includes wide, substantially flat surfaces formed on opposite sides of the blade. The pick further includes fins projecting outward from the flat surfaces. An alternative embodiment of the pick also includes a stabilizer that extends outward from the blade and the fins.

12 Claims, 1 Drawing Sheet

FIG. 1
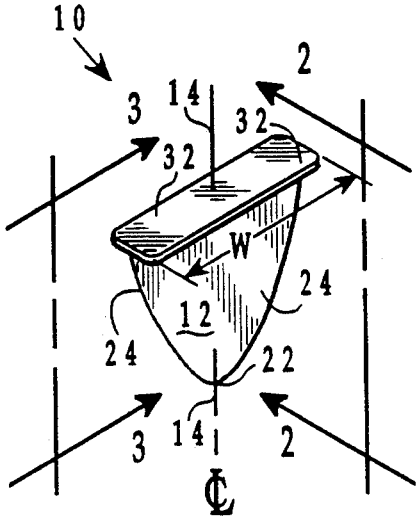
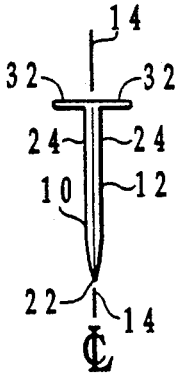
FIG. 3
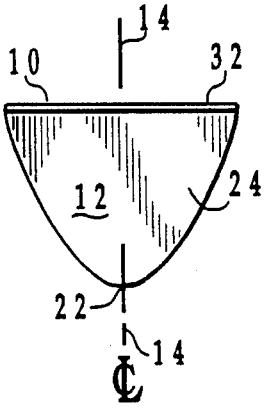
FIG. 2
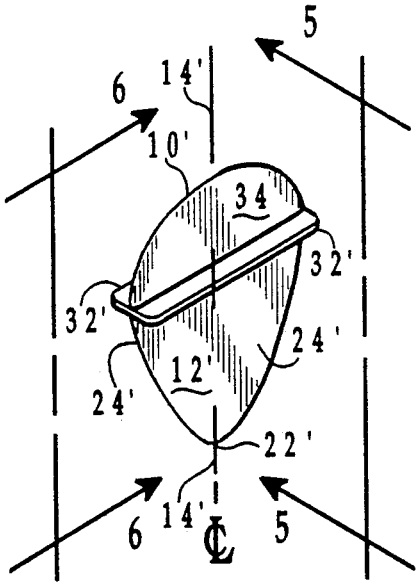
FIG. 4
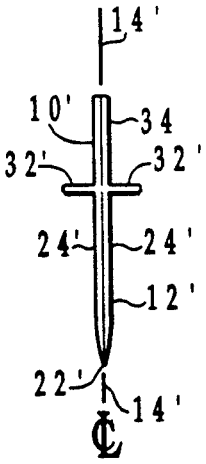
FIG. 6
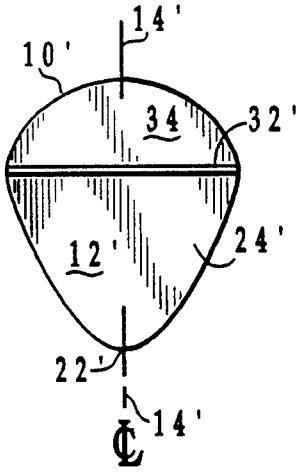
FIG. 5

PICK FOR STRINGED MUSICAL INSTRUMENTS

BACKGROUND OF THE INVENTION

1. Field of the Invention

The present invention relates generally to the field of stringed musical instruments and, more particularly, to picks or plectrums that musicians frequently use in playing plucked string musical instruments of the lute family such as guitars, banjos, mandolins, lyres, and zithers.

2. Description of the Prior Art

One class of picks commonly used by musicians in playing plucked string musical instruments, that frequently is molded from a plastic material in any one of a variety of different shapes, consists of a substantially planar, pointed blade for plucking the strings. To use this particular type of pick, a musician grips it firmly between a thumb and a finger of one hand. A well recognized difficulty with this type of pick is its tendency to slip from the musician's grasp. However, firmly gripping such a pick to prevent dropping it creates tension in the muscles of the forearm of the hand holding the pick, and concurrent stiffness and rigidity in a musician's wrist and hand. Conversely, speed and mobility of hand movement, that is essential for smoothly and clearly executing musical passages while playing such an instrument, requires this same forearm to be relaxed and free from tension.

Somewhat elaborate attempts have been made to provide picks that are easier to hold and retain while playing a stringed musical instrument. For example, U.S. Pat. No. 655,959, entitled "Mandolin Pick Holder" that issued Aug. 14, 1900 on an application filed in the name of Carolyn M. Cochrane, discloses a hollow cylinder having closed ends and a roughened surface that is pierced by a slot for receiving a pick. U.S. Pat. No. 998,440, entitled "Mandolin Pick" that issued Jul. 18, 1911 on an application filed in the name of Arnold F. Willat, discloses a pick in which the flat body is flexibly joined to a cylindrically-shaped cross-bar. U.S. Pat. No. 1,009,403, entitled "Pick for Mandolins, Zithers, and Similar stringed Musical Instruments" that issued on Nov. 21, 1911 on an application filed in the name of Joseph Gaynor ("the Gaynor Patent"), discloses a pick composed of a resilient pointed blade and of a rigid saucer shaped finger piece secured to one side of the blade by an eyelet. In using this pick, the musician establishes a suction that increases the firmness of the grip by pressing the thumb into the bowl of the finger piece and then closing the eyelet with one of the hand's other fingers. U.S. Pat. No. 1,117,056, entitled "Musical Instrument Pick" that issued on Nov. 10, 1914 on an application filed in the name of Louis C. Knackestedt, discloses a pick pierced by a plurality of openings that receive rubber plugs that project out from both sides of the pick. The projecting rubber plugs provide spurs that permit more easily gripping the pick. U.S. Pat. No. 1,263,740, entitled "Pick for Stringed Instruments" that issued Apr. 23, 1918 on an application filed in the name of Aaron Burdwise, discloses a pick having two loops of wire respectively secured to and juxtaposed with both sides of the pick. U.S. Pat. No. 1,461,070, entitled "Pick for Stringed Instruments" that issued Jul. 10, 1923 on an application filed in the name of Peter M. Rudesyle, discloses a pick having a circle of alternating, pie-shaped depressed troughs and raised ridges formed on both sides of the pick. U.S. Pat. No. 3,112,668, entitled "Instrument for Playing Guitars, Banjos and the Like" that issued Dec. 3, 1963 on an application filed in the name of Joseph S. Moshay, discloses a pick that, similar to the Gaynor Patent, is pierced by a hole that, in use, is closed by the musician's thumb and one finger.

SUMMARY OF THE INVENTION

An object of the present invention is to provide a pick for stringed musical instruments that may be held more securely.

Another object of the present invention is to provide a pick for stringed musical instruments that is less easily dropped.

Another object of the present invention is to provide a pick for stringed instruments that a musician may hold securely without creating tension in the muscles of the forearm of the hand holding the pick.

Another object of the present invention is to provide a pick for stringed musical instruments that a musician may hold without the wrist and hand becoming stiff and rigid.

Another object of the present invention is to provide a pick for stringed musical instruments that facilitates executing musical passages smoothly and clearly when playing such an instrument.

Briefly the present invention includes a unitary pick for plucking a stringed musical instrument that includes a flat blade having a longitudinal axis. The blade is formed with a point at one end of its longitudinal axis for engaging strings of a musical instrument. The blade also includes wide, substantially flat surfaces formed on opposite sides of the blade extending along the longitudinal axis projecting away from its pointed end. The pick further includes either one, or preferably two, substantially straight fin or fins projecting outward from one or both of the blade's wide, substantially flat surfaces. The fin or fins preferably extend across the entire width of the blade and are positioned at a right angle to the blade's longitudinal axis. The fin or fins have a thickness parallel to the pick's longitudinal axis which is no greater than a distance which the fin or fins project outward from the surface of the blade. In use, the pick is held in a musician's hand by contact with the fin and one flat surface of the blade of a pick having only a single fin, or by contact with both fins of a pick having two fins. Held in this way, the flat surface or surfaces from which the fin or fins project stabilize the pick in a musician's hand without creating excessive tension or rigidity the forearm and/or wrist.

One embodiment of the pick of the present invention also includes a stabilizer that extends outward from the blade and the fin or fins, about the blade's longitudinal axis projecting away from the pointed end of the blade. The stabilizer preferably continues the shape of the blade and its flat surfaces outward beyond the fin or fins. Including the stabilizer in the pick increases its surface area that provides stability when the pick is held between a musician's thumb and first finger.

These and other features, objects and advantages will be understood or apparent to those of ordinary skill in the art from the following detailed description of the preferred embodiment as illustrated in the various drawing figures.

BRIEF DESCRIPTION OF THE DRAWINGS

FIG. 1 is a perspective view depicting a pick in accordance with the preferred embodiment of the present invention;

FIG. 2 is a frontal plan view of the pick of FIG. 1 taken along the line 2—2 of FIG. 1;

FIG. 3 is a side plan view of the pick of FIG. 1 taken along the line 3—3 of FIG. 1;

FIG. 4 is a perspective view depicting an alternative embodiment of the pick in accordance with the present invention;

FIG. 5 is a frontal plan view of the alternative embodiment pick of FIG. 4 taken along the line 5—5 of FIG. 4; and FIG. 6 is a side view of the alternative embodiment pick of FIG. 4 taken along the line 6—6 of FIG. 4.

DETAILED DESCRIPTION OF THE PREFERRED EMBODIMENT

FIGS. 1-3 depict a one-piece pick or plectrum in accordance with the present invention referred to by the general reference character 10. The unitary pick 10 includes a flat blade 12 having a longitudinal, center-line axis 14. The unitary pick 10 is preferably shaped symmetrically about the center-line axis 14. The blade 12 is formed with a pointed end 22 at one end of the longitudinal axis 14 that adapts the unitary pick 10 for engaging the strings of a musical instrument (not illustrated in any of the FIGS.). Both sides of the blade 12 along its longitudinal axis 14 away from its pointed end 22 provide wide, substantially flat surfaces 24. Each flat surface 24 has a maximum width "W" as illustrated in FIG. 1.

In addition to the blade 12, the unitary pick 10 includes a pair of fins 32 that preferably project symmetrically outward respectively from the flat surfaces 24 at the end of the blade 12 furthest from the pointed end 22. Each fin 32 is preferably formed with a substantially rectangular cross-sectional shape, disposed normal to the longitudinal axis 14 of the blade 12, and extends across the entire width "W" of the flat surface 24. Furthermore, each fin 32 has a thickness parallel to the longitudinal axis 14 which is no greater than a distance which the fin 32 projects outward from the flat surface 24 of the blade 12.

The fins 32, when held lightly between the thumb and first finger of a hand, engage the surface of the thumb and first finger to provide a fulcrum for the flat surfaces 24 of the blade 12. Held in this way, the flat surfaces 24 function as stabilizers for the unitary pick 10 rather than as its gripping surfaces. Holding the unitary pick 10 by the fins 32 and stabilizing it with the flat surfaces 24 significantly reduces tension in a musician's forearm in comparison with a pick lacking the fins 32.

FIGS. 4-6 depict an alternative embodiment of the unitary pick 10. Those elements depicted in FIGS. 4-6 that are common to the unitary pick 10 depicted in FIGS. 1-3 carry the same reference numeral distinguished by a prime ("′") designation. In addition to the blade 12′ and the fins 32′, the alternative embodiment of the unitary pick 10 illustrated in FIGS. 4-6 also includes a stabilizer 34 that extends outward from the blade 12′ and the fins 32′. The stabilizer 34′ continues the shape of the blade 12′ and its flat surfaces 24′ outward beyond the fins 32′. The stabilizer 34 is preferably formed symmetrically about the center-line axis 14′ projecting away from the pointed end 22′ beyond the fins 32′. Including the stabilizer 34 in the unitary pick 10′ increases the surface area of the unitary pick 10′ that provides its stability when the unitary pick 10′ is held between the thumb and first finger of a hand.

While some musicians may prefer a unitary pick 10′ having the stabilizer 34 illustrated in FIGS. 4-6 for its increased stability, as described above a pick 10 in accordance with the present invention that omits the stabilizer 34 substantially provides the advantages and achieves results similar to those of the unitary pick 10′ that includes the stabilizer 34. Furthermore, some musicians find the smaller size of the pick 10 more desirable than the larger pick 10′.

Various different sizes and other modifications may be made in the unitary picks 10 and 10′ while substantially retaining the advantages and achieving results similar to those disclosed for the unitary picks 10 and 10′. Thus, for example, a pick that omits one of the fins 32 or 32′, or that has a fin or fins 32 or 32′ that extend less than completely across the full width "W" of the flat surface 24 or 24′ can substantially retain the advantages and achieve the results of the present invention. Also, the fins 32 or 32′ need not project outward a uniform distance from the surfaces 24 or 24′ across the full width "W" of the blade 12 or 12′. For example, the outer edge of the fins 32 or 32′ furthest from the flat surfaces 24 or 24′ might have a concave shape with the narrowest portion of the fins 32 or 32′ occurring adjacent to the longitudinal axis 14 or 14′ of the blade 12 or 12′. Such a concave shape for the fins 32 or 32′ adapts them to fit the shape of a musician's thumb and first finger. Similarly, a pick having fins 32 or 32′ that are disposed at an oblique angle with respect to the longitudinal axis 14 or 14′, or that do not have a substantially rectangular cross-sectional shape can also substantially retain the advantages and achieve the results of the present invention. Furthermore, the unitary pick 10 or 10′ need not be symmetric about the longitudinal axis 14 or 14′.

The unitary picks 10 and 10′ may be made from various plastic materials including nylon. A material suitable for fabrication into the unitary picks 10 and 10′ must be fairly rigid while simultaneously being slightly bendable so the unitary pick 10 or 10′ may easily slide off the strings of a musical instrument. The unitary pick's 10 and 10′ are preferably fabricated from any such plastic material by injection molding, or such other technique as may prove advantageous for manufacturing and/or commercial considerations.

Although the present invention has been described in terms of the presently preferred embodiments, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A unitary pick for plucking a stringed musical instrument comprising a flat blade having a longitudinal axis and a maximum width in a direction that is normal to said longitudinal axis, said blade being formed with a point at one end of the longitudinal axis that adapts said unitary pick for engaging strings of an instrument, said blade also being formed with wide, substantially flat surfaces on opposite sides of said blade extending along the longitudinal axis away from the pointed end of said blade, said unitary pick also having a substantially straight fin projecting outward from a first one of the wide, substantially flat surfaces of said blade, said fin extending across no more than the maximum width of said blade and being disposed at an angle that is not parallel to the longitudinal axis of said blade, said fin having a thickness parallel to the longitudinal axis which is no greater than a distance which said fin projects outward from the first substantially flat surface of said blade, said pick being adapted to be held within a musician's hand by contact with said fin and to be stabilized there by one of the flat surfaces of said blade.

2. The unitary pick of claim 1 further comprising a second substantially straight fin projecting outward from a second of the wide, substantially flat surfaces of said blade, said second fin extending across substantially the maximum width of said blade and being disposed at an angle that is not parallel to the longitudinal axis of said blade.

3. The unitary pick of claim 2 wherein said fins project symmetrically with respect to the longitudinal axis of said blade from the wide, substantially flat surfaces of said blade.

4. The unitary pick of claim 2 wherein said fins are disposed normal to the longitudinal axis of said blade.

5. The unitary pick of claim 4 wherein said fins extend across the maximum width of the substantially flat surface of said blade.

6. The unitary pick of claim 5 further comprising a stabilizer that extends outward from said blade and said fins about the longitudinal axis of said blade that projects away from the pointed end of said blade.

7. The unitary pick of claim 6 wherein said fins are formed with a substantially rectangular cross-sectional shape.

8. The unitary pick of claim 2 wherein said fins are formed with a substantially rectangular cross-sectional shape.

9. The unitary pick of claim 1 further comprising a stabilizer that extends outward from said blade and said fin about the longitudinal axis of said blade that projects away from the pointed end of said blade.

10. The unitary pick of claim 1 wherein said fin is disposed normal to the longitudinal axis of said blade.

11. The unitary pick of claim 1 wherein said fin extends across the maximum width of the substantially flat surface of said blade.

12. The unitary pick of claim 1 wherein said fin is formed with a substantially rectangular cross-sectional shape.

* * * * *